US005531175A

United States Patent [19]

Vezzoli

[11] Patent Number: 5,531,175

[45] Date of Patent: Jul. 2, 1996

[54] ALIGNMENT, EJECTION AND DRAGGING APPARATUS FOR SEWING BUCKLES AND BELT CARRIERS ON BELTS

[76] Inventor: Osvaldo Vezzoli, via dei Videtti, 8-24064, Grumello del Monte, Italy

[21] Appl. No.: 317,463

[22] Filed: Oct. 4, 1994

[30] Foreign Application Priority Data

Oct. 14, 1993 [IT] Italy ..... BG93A0045

[51] Int. Cl.[6] ..... D05B 3/12; D05B 33/00; D05B 35/06; D05B 41/00

[52] U.S. Cl. ..... 112/470.33; 112/152; 112/470.36

[58] Field of Search ..... 112/25, 27, 115, 112/104, 152, 311, 470.28, 470.33, 470.34, 470.36, 475.07, 475.14; 224/163

[56] References Cited

U.S. PATENT DOCUMENTS

| | | | |
|---|---|---|---|
| 2,824,595 | 2/1958 | Lehre | 112/113 |
| 2,847,954 | 8/1958 | Brownstein | 112/121.27 |
| 3,133,514 | 5/1964 | Winberg | 112/121.27 |
| 3,898,119 | 8/1975 | Barr et al. | 112/121.27 X |
| 4,046,088 | 9/1977 | Asel et al. | 112/121.27 X |
| 4,157,687 | 6/1979 | Cislak | 112/121.27 |
| 4,389,957 | 6/1983 | Block et al. | 112/121.27 X |

*Primary Examiner*—C. D. Crowder
*Assistant Examiner*—Ismael Izaguirre
*Attorney, Agent, or Firm*—Bucknam and Archer

[57] ABSTRACT

An interchangeable guide (4) is applied on the mobile plane (2) of a sewing machine, for the alignment of the belt carrier(s) (5) of belts (6), pre-arranged for the sewing of buckles (7). To the guide a transversal lever (12) is coupled for the ejection of the sewn belts and the alignment and hooking of same in a traction fork (14) connected to a transversal dragging piston (15) provided for the taking away of sewn belts, their temporary alignment relatively to a device (19) for the removal of the protruding thread ends and the alignment and unloading of the belts into collection containers (20).

8 Claims, 2 Drawing Sheets

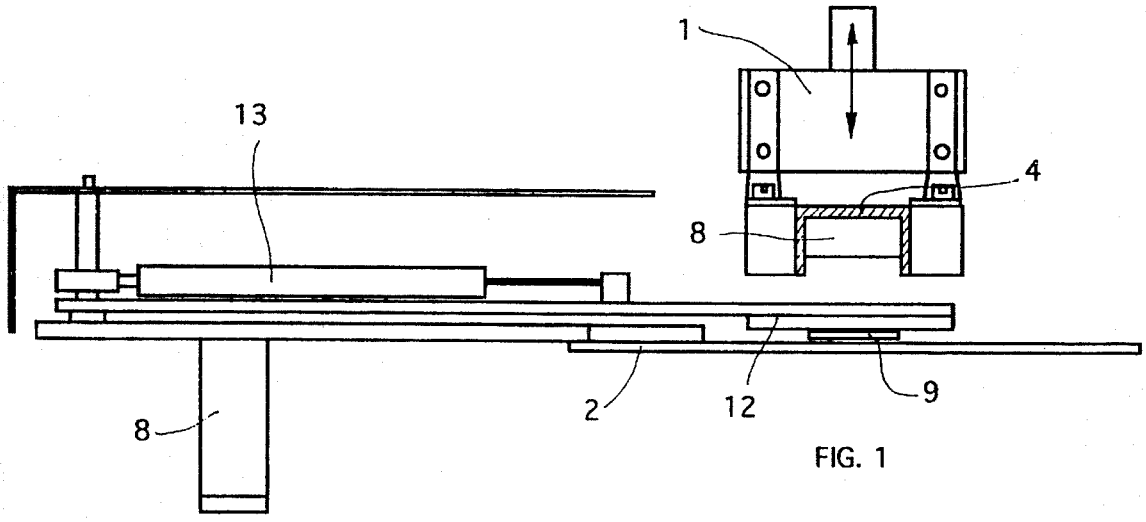
FIG. 1
FIG. 2
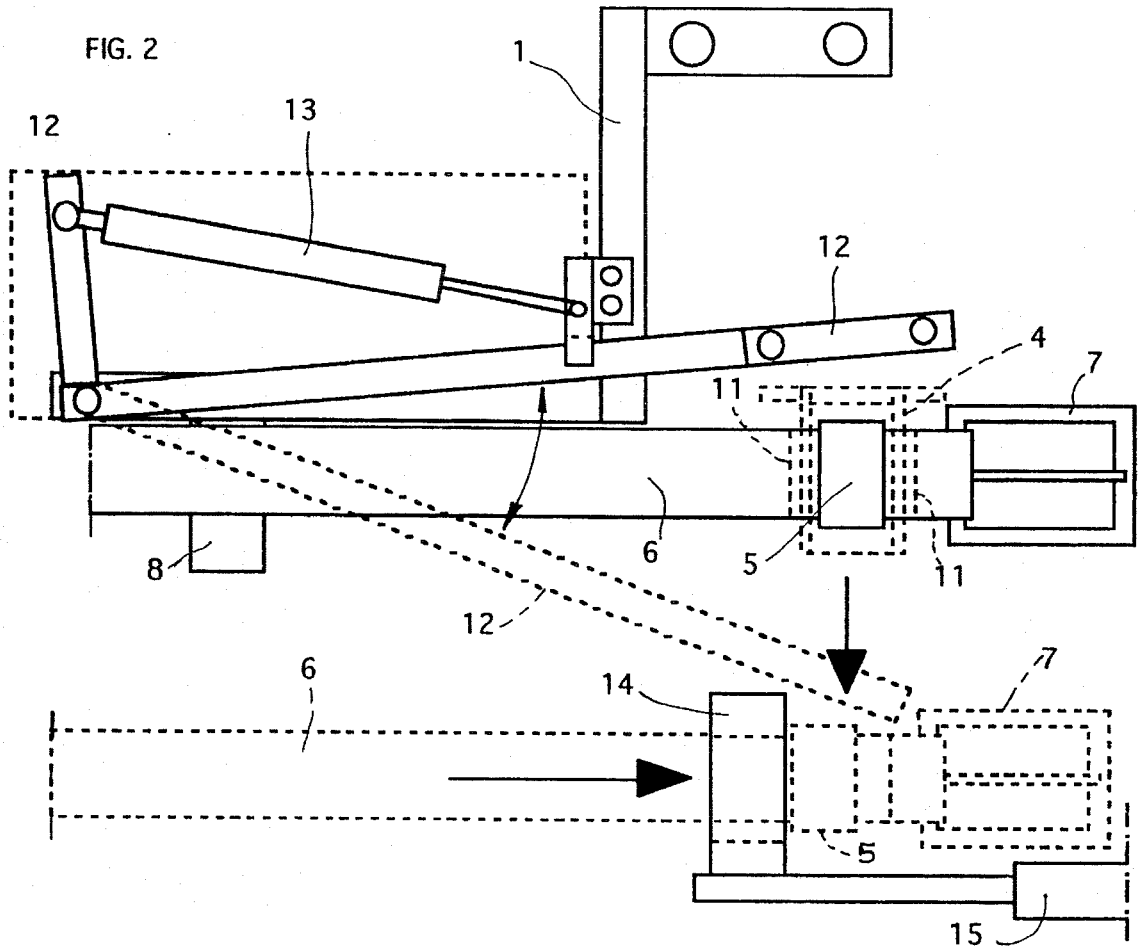

ALIGNMENT, EJECTION AND DRAGGING APPARATUS FOR SEWING BUCKLES AND BELT CARRIERS ON BELTS

FIELD OF THE INVENTION

The invention relates to an apparatus comprising an interchangeable guide for the engagement of the belt carrier(s), already pre-mounted on the belts for the sewing operation, together with the corresponding buckles, and an alternated movement transversal ejection lever. The flat bed, positionable according to coordinates pre-established and planned with temporized halts, draws up in such a way as to cause the needle of the sewing machine to perform the sewing operating stages along the of the interchangeable guide.

BACKGROUND OF THE INVENTION

Once seams are ready, the needle lifting is followed by a translation of the transversal lever, which pushes towards the outside the belt with the relevant carrier(s) and the buckle suitably connected by a seam, until the belt engages with a hooking fork integral with a longitudinal dragging device. Once hooked, the sewn and completed belt is longitudinally dragged until the above seams are positioned on special means for the removal of the protruding thread residues, after which it is unloaded into underlying aligned containers.

The whole is carried out automatically, through cycles planned and temporized according to the type of belt, the number and type of carriers, the type of buckle, the type of sewing-thread. The procedures utilized by the known art for connecting buckles and carriers to belts require a pre-positioning of said details and a subsequent hand intervention which aligns, as much as possible, the belts to the heads of the sewing machine, as well as the keeping of their correct positioning during the sewing operation. It is therefore obvious that such workings are only entrusted to the capability and the experience of the operators and that the final results are not uniform and homogeneous.

Besides, after the sewing, belts have to be hand extracted from beneath the operating heads, and sent on, always by hand, to the subsequent finishing stages, including the cutting of the protruding thread residues and the stacking in the containers for the collection and/or manufacturing.

Such operations are time-consuming, require much manpower and space, are substantially uneconomical and do not contribute to the necessary and wished production increases.

SUMMARY OF THE INVENTION

An object of this invention is to eliminate the above drawbacks. The invention, solves the problems by means of an apparatus for the alignment, ejection and dragging of buckles and carriers on belts, by means of which the following results are obtained: the whole is applied on the slide plate of a sewing machine and comprises an interchangeable guide for the alignment of the already pre-mounted belt carrier(s), together with the buckles, of said belts, to be sewn. The alignment guide is coupled to a transversal ejection lever and to a device for the dragging and unloading hooking; the alignment guide may be simple or multiple for one or more coupled carriers; the control for the positioning of the sewing needle, the stages of sewing astride the side of said alignment guide, the lifting of said guide, the ejection of the sewn belts, the hooking of same and the dragging on to the stations of thread end cutting and of collection are planneable, temporized, sequential and automatic through PLC (Programmable Logic Control) or the like.

The advantages achieved through this invention consist basically in that the automation of the whole process of alignment, sewing and unloading ensure the utmost homogeneity of the product, the best finishings, a remarkable increase in the hourly output and a good saving of manpower.

BRIEF DESCRIPTION OF THE DRAWINGS

The invention is described with more details in the following, according to a preferred non limitative embodiment, illustrated only by way of example, with reference to the attached drawings, wherein:

FIG. 1 is a schematic front view of the alignment and ejection device, aligned with a sewing head;

FIG. 2 is a schematic plant view of the same device;

Figure 3:
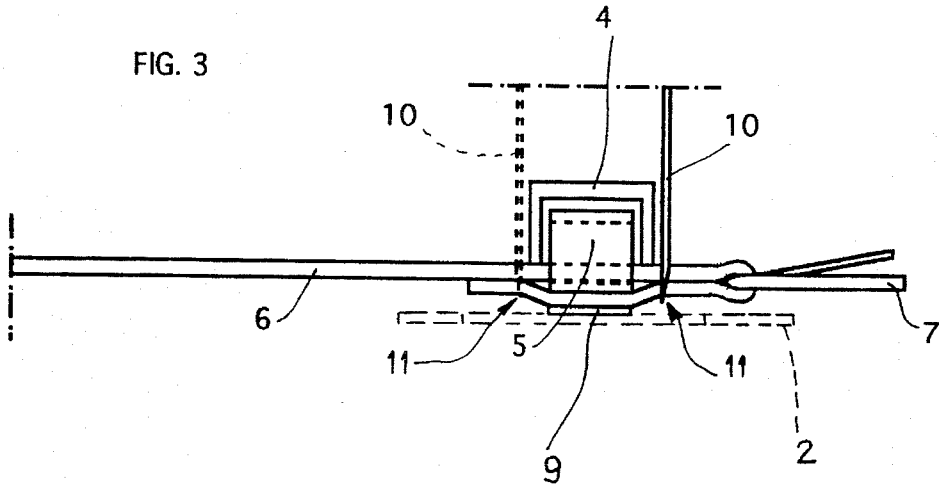
FIG. 3 shows the detail of a one-carrier belt, engaged in the alignining guide, in sewing position.
Figure 4:
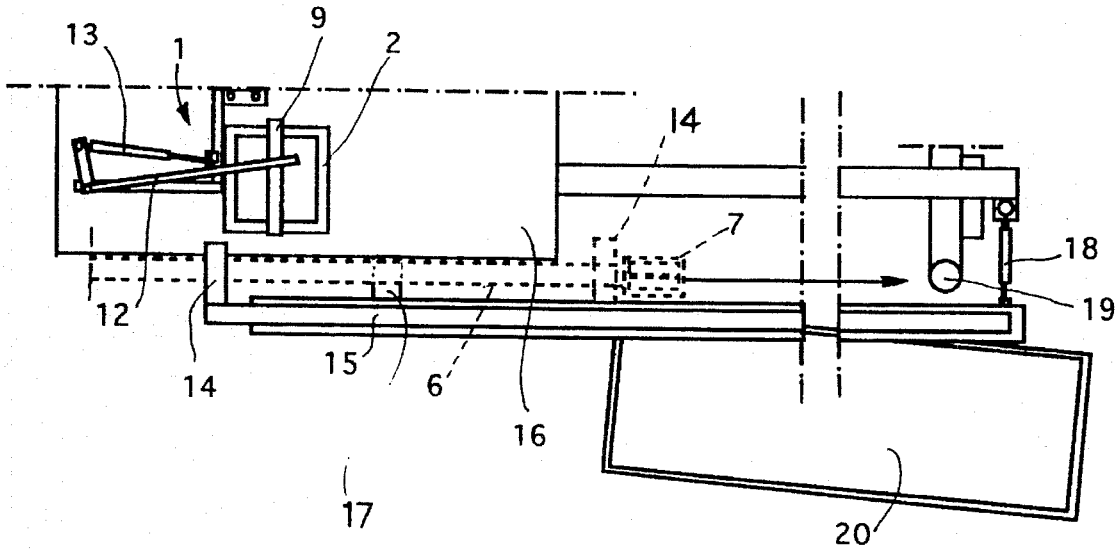
FIG. 4 is a schematic plant view of the system of dragging, of elimination of the sewing thread ends, and of collection of the belts.

The figures show an apparatus for the alignment, ejection and dragging for the sewing of buckles and carriers on belts, substantially constituted by a structure (1), connectable to the slide plate (2) of a sewing machine, comprising at least an interchangeable guide (4) so configurated as to house at least a carrier (5) already prepositioned transversally relatively to a belt (6), to which also the corresponding buckle (7) is preinserted. The hand insertion of the carriers (5) in the guide(s), or in the simple or multiple guide, involves an automatic alignment of the belts (6) against side sights (8) provided on said guide and the structure (1). The interchangeable guide(s) may be of the type closed on the upper part, for non rigid normal carriers (5), or may be provided with upper guide grooves, for rigid and/or approached metal carriers. According to the type of belt with several carriers, guide (4) will be suitably configurated for their restraint.

In the example illustrated, one only guide (4) for one only carrier (5) is shown. Once carrier (5) has been inserted, prealigned with the bent edge of the corresponding belt (6) and buckle (7), guide (4) lowers, pressing said belt against a transversal support whose size allows for the free passage of the sewing needle along the sides of said guide.

In fact, in such position, the slide plate (2) shifts transversally, aligning first the one then the other side of guide (4) with needle (10), which needle carries out the sewing.

At the end, with the needle lifted and in standstill position, guide (4) is caused to lift and belt (6), complete with seams (11) which restrain buckle (7) and carrier (5), is free and ready to be ejected from its position by means of a transversal lever (12) which has its fulcrum on the back of structure (1) and which is provided with an actuator, such as for instance a pneumatic piston (13).

The transversal lever (12) pushes the sewn belt (6) against a fork (14) integral with a dragging device (15), which may be of the protected piston type of or some other type.

Piston (15) is substantially aligned with the flat-bed (16) of the sewing machine, but comprises preferably, but not limitedly, a transversal back control (18), which, during the dragging, aligns the seams just made on the belt to a heat source, for instance a hot air source (19), which removes the residual protruding ends of the sewing threads. Afterwards, the continuation of such transversal shifting with rotation of piston (15) around an intermediate fulcrum (17), cause the finished belt to align with an interchangeable lower container (20), wherein the belt is caused to fall, by slipping it off from fork (14).

The aforementioned sequential operating stages are planned through PLC (Programmable Logic Control) or the like, with temporizations, strokes and stages which depend on the types of belts to be worked.

Guides (4) are interchangeable depending on the type of belt carriers—from leather or metal—and the number of carriers; in this case, the guides may be double or single, coupled with several transversal seams.

While the apparatus subject matter of this invention has been described and illustrated according to an embodiment given by way of example, it shall be clear to those expert of the art that many changes can be made in the structure and details, without exceeding the protection scope of the invention.

I claim:

1. Alignment, ejection and dragging apparatus for sewing buckles and belt carriers on belts, the apparatus comprising a) an interchangeable guide (4) for aligning the belt carriers (5) of belts (6) prearranged for the sewing of buckles (7), b) a transversal ejecting lever (12), said guide being coupled to said lever, c) a traction hooking fork (14), said guide being coupled to said fork, d) dragging devices (15), said fork being engaged with said dragging devices (15), e) devices (19), said dragging devices aligning with said devices (19) for removing the protruding sewing end, and for aligning and unloading sewn belts (6) in collection containers (20).

2. The apparatus according to claim 1, said apparatus being connectable to a sewing machine, said sewing machine having a slide plate (2), said apparatus being connectable to said slide plate, said sewing machine having a head, wherein said interchangeable guide (4) has a configuration structurally capable of being closed and also being simple-channelled, double or multiple, elastic and rigid, and depending on the number of carriers (5), said guide being applied to said slide plate (2), said guide having sides, said sides aligning with said head of said sewing machine by horizontal motions, said guide pressing and dropping the belts being worked by vertical motions.

3. The apparatus according to claim 2, wherein said belts are prealigned and have a supporting base, said slide plate (2) comprises a transversal support (9) which aligns with said interchangeable guide (4), constituting said supporting base of the prealigned belts (6), each of said belts having an edge, each of said edges receiving a buckle (7) with the edge receiving buckle (7).

4. The apparatus according to claim 1, which is provided with means for alternately ejecting and reversing the motion of said transversal lever (12) and with means for lifting and lowering said interchangeable guide (4), whereby said transversal lever (12) has an alternate ejection and reversal motion, said motion being synchronized with the lifting and lowering movement of said interchangeable guide (4).

5. The apparatus according to claim 4, which is provided with a fork (14), said fork engaging said belts (6), said transversal ejection lever (12) aligning with said fork (14) after the buckles (7) have been sewn; said fork being integral with a dragging device (15), said dragging device being of the piston type.

6. The apparatus according to claim 5, which comprises a source of heat (19), and said belts (6) have sewn parts and protruding residual ends of the sewing threads, said dragging device (15) slides along a path which brings said fork (14) in alignment with said source of heat (19), the sewn parts of the belts drawing up to said source of heat, said source of heat being capable of removing said protruding residual ends of the sewing threads.

7. The apparatus according to claim 6, wherein each of said said dragging devices (15) has a fulcrum (17) and the apparatus is provided with a transversal back control (18), said transversal back control being synchronized with said source of heat (19) and with said collection containers (20), whereby the finished belts (6), unloaded by said fork (14) are collected into said containers.

8. The apparatus according to claim 7, wherein said fork (14) is a hooking and traction fork, the apparatus is provided with a programmable logic control, said interchangeable guide (4) performs alternate, synchronized and sequential movements, each of said alternate, synchronized and sequential movements of said interchangeable guide (4), the transversal ejection lever (12), said hooking and traction fork (14), said dragging device (15), said transversal back control (18), are programmable according to the type of belts (6) to be completed with the sewing of said carriers (5) and belts (7) and are controlled by means of said programmable logic control.

* * * * *